US007131276B2

(12) United States Patent
Pan et al.

(10) Patent No.: US 7,131,276 B2
(45) Date of Patent: Nov. 7, 2006

(54) PULSE TUBE REFRIGERATOR

(75) Inventors: Huaiyu Pan, Oxford (GB); Timothy Hughes, Eynsham (GB); Keith White, Abingdon (GB)

(73) Assignee: Oxford Magnet Technologies Ltd., Eynsham/Oxford (GB)

( * ) Notice: Subject to any disclaimer, the term of this patent is extended or adjusted under 35 U.S.C. 154(b) by 164 days.

(21) Appl. No.: 10/702,046

(22) Filed: Nov. 6, 2003

(65) Prior Publication Data

US 2004/0112065 A1 Jun. 17, 2004

(30) Foreign Application Priority Data

Nov. 7, 2002 (GB) ..... 0226000

(51) Int. Cl.
*F25B 9/00* (2006.01)

(52) U.S. Cl. ..... 62/6

(58) Field of Classification Search ..... 62/6; 165/10, 4

See application file for complete search history.

(56) References Cited

U.S. PATENT DOCUMENTS

| | | | | | |
|---|---|---|---|---|---|
| 1,734,136 | A | * | 11/1929 | Kramer | 165/184 |
| 2,737,370 | A | * | 3/1956 | Frisch et al. | 165/134.1 |
| 4,103,408 | A | * | 8/1978 | Joekel | 29/890.048 |
| 4,951,739 | A | * | 8/1990 | Cates et al. | 165/10 |
| 5,107,683 | A | * | 4/1992 | Chan et al. | 62/6 |
| 5,295,355 | A | * | 3/1994 | Zhou et al. | 62/6 |
| 5,435,136 | A | | 7/1995 | Ishizaki et al. | 60/517 |
| 5,582,246 | A | * | 12/1996 | Dinh | 165/181 |
| 5,583,472 | A | | 12/1996 | Moritsu et al. | |
| 5,613,367 | A | | 3/1997 | Chen | |
| 5,746,269 | A | * | 5/1998 | Torii et al. | 165/10 |
| 5,791,149 | A | * | 8/1998 | Dean | 62/6 |
| 5,918,470 | A | | 7/1999 | Xu et al. | |
| 6,378,312 | B1 | * | 4/2002 | Wang | 62/6 |
| 6,591,609 | B1 | * | 7/2003 | Kamen et al. | 60/526 |
| 6,691,520 | B1 | * | 2/2004 | Kamoshita et al. | 62/6 |

FOREIGN PATENT DOCUMENTS

| | | | |
|---|---|---|---|
| GB | 2 237 866 A | | 10/1990 |
| GB | 2382127 A | * | 5/2003 |
| JP | 53-132449 | * | 11/1978 |
| JP | 61-159093 | * | 7/1986 |
| JP | 2003-21412 | * | 1/2003 |

* cited by examiner

*Primary Examiner*—Denise L. Esquivel
*Assistant Examiner*—Richard L. Leung
(74) *Attorney, Agent, or Firm*—Crowell & Moring LLP

(57) ABSTRACT

The present invention relates to pulse tube refrigerators for recondensing cryogenic liquids. In particular, the present invention relates to the same for magnetic resonance imaging systems. In many cryogenic applications components, e.g. superconducting coils for magnetic resonance imaging (mri), superconducting transformers, generators, electronics, are cooled by keeping them in contact with a volume of liquified gases (e.g. helium, neon, nitrogen, argon, methane). In a first aspect, the present invention provides a pulse tube refrigerator PTR pulse tube refrigerator (PTR) arrangement within a cryogenic apparatus, wherein a regenerator tube of the PTR is finned. In this configuration the fins or baffles, are believed to increase the surface area available for distributed heat transfer from the helium atmosphere to the regenerator.

17 Claims, 11 Drawing Sheets

PULSE TUBE REFRIGERATOR

FIELD OF THE INVENTION

The present invention relates to pulse tube refrigerators for recondensing cryogenic liquids. In particular, the present invention relates to the same for magnetic resonance imaging systems.

BACKGROUND TO THE INVENTION

In many cryogenic applications components, e.g. superconducting coils for magnetic resonance imaging (MRI), superconducting transformers, generators, electronics, are cooled by keeping them in contact with a volume of liquefied gases (e.g. Helium, Neon, Nitrogen, Argon, Methane). Any dissipation in the components or heat getting into the system causes the volume to part boil off. To account for the losses, replenishment is required. This service operation is considered to be problematic by many users and great efforts have been made over the years to introduce refrigerators that recondense any lost liquid right back into the bath.

As an example of prior art, an embodiment of a two stage Gifford McMahon (GM) coldhead recondenser of an MRI magnet is shown in FIG. 1. In order for the GM coldhead, indicated generally by 10, to be removable for service or repair, it is inserted into a sock, which connects the outside face of a vacuum vessel 16 (at room temperature) to a helium bath 18 at 4K. MRI magnets are indicated at 20. The sock is made of thin walled stainless steel tubes forming a first stage sleeve 12, and a second stage sleeve 14 in order to minimise heat conduction from room temperature to the cold end of the sock operating at cryogenic temperatures. The sock is filled with helium gas 30, which is at about 4.2 K at the cold end and at room temperature at the warm end. The first stage sleeve 12 of the coldhead is connected to an intermediate heat station of the sock 22, in order to extract heat at an intermediate temperature, e.g. 40K–80 K, and to which sleeve 14 is also connected. The second stage of the coldhead 24 is connected to a helium gas recondenser 26. Heat arises from conduction of heat down through the neck, heat radiated from a thermal radiation shield 42 as well as any other sources of heat for example, from a mechanical suspension system for the magnet, (not shown) and from a service neck (also not shown) used for filling the bath with liquids, instrumentation wiring access, gas escape route etc. The intermediate section 22 shows a passage 38 to enable helium gas to flow from the volume encircled by sleeve 14. A number of passages may be annularly distributed about the intermediate section. The latter volume is also in fluid connection with the main bath 18 in which the magnet 20 is placed. Also shown is a flange 40 associated with sleeve 12 to assist in attaching the sock to the vacuum vessel 16. A radiation shield 42 is placed intermediate the helium bath and the wall of the outer vacuum vessel.

The second stage of the coldhead is acting as a recondensor at about 4.2 K. As it is slightly colder than the surrounding He gas, gas is condensed on the surface (which can be equipped with fins to increase surface area) and is dripped back into the liquid reservoir. Condensation locally reduces pressure, which pulls more gas towards the second stage. It has been calculated that there are hardly any losses due to natural convection of Helium, which has been verified experimentally provided that the coldhead and the sock are vertically oriented (defined as the warm end pointing upwards). Any small differences in the temperature profiles of the Gifford McMahon cooler and the walls would set up gravity assisted gas convection, as the density change of gas with temperature is great (e.g. at 4.2. K the density is 16 $kg/m^3$; at 300 K the density is 0.16 $kg/m^3$). Convection tends to equilibrate the temperature profiles of the sock wall and the refrigerator. The residual heat losses are small.

When the arrangement is tilted, natural convection sets up huge losses. A solution to this problem has been described in U.S. patent, U.S. Pat. No. 5,583,472, to Mitsubishi. Nevertheless, this will not be further discussed here, as this document relates to arrangements which are vertically oriented or at small angles (<30°) to the vertical.

It has been shown that Pulse Tube Refrigerators (PTRs) can achieve useful cooling at temperatures of 4.2 K (the boiling point of liquid helium at normal pressure) and below (C. Wang and P. E. Gifford, Advances in Cryogenic Engineering, 45, Edited by Shu et a., Kluwer Academic/Plenum Publishers, 2000, pp. 1–7). Pulse tube refrigerators are attractive, because they avoid any moving parts in the cold part of the refrigerator, thus reducing vibrations and wear of the refrigerator. Referring now to FIG. 2, there is shown a PTR 50 comprising an arrangement of separate tubes, which are joined together at heat stations. There is one regenerator tube 52, 54 per stage, which is filled with solid materials in different forms (e.g. meshes, packed spheres, powders). The materials act as a heat buffer and exchange heat with the working fluid of the PTR (usually He gas at a pressure of 1.5–2.5 MPa). There is one pulse tube 56, 58 per stage, which is hollow and used for expansion and compression of the working fluid. In two stage PTRs, the second stage pulse tube 56 usually links the second stage 60 with the warm end 62 at room temperature, the first stage pulse tube 58 linking the first stage 64 with the warm end.

It has been found, that PTRs operating in vacuum under optimum conditions usually develop temperature profiles along the length of the tubes that are significantly different one tube to another in the same temperature range and also from what would be a steady state temperature profile in a sock. This is shown in FIG. 3.

Another prior art pulse tube refrigerator arrangement is shown in FIG. 4 wherein a pulse tube is inserted into a sock, and is exposed to a helium atmosphere wherein gravity induced-convection currents 70, 72 are set up in the first and second stages. The PTR unit 50 is provided with cold stages 31, 33 which are set in a recess in an outer vacuum container 16. A radiation shield 42 is provided which is in thermal contact with first sleeve end 22. A recondenser 26 is shown on the end wall of second stage 33. If at a given height the temperatures of the different components are not equal, the warmer components will heat the surrounding helium, giving it buoyancy to rise, while at the colder components the gas is cooled and drops down. The resulting thermal losses are huge, as the density difference of helium gas at 1 bar changes by a factor of about 100 between 4.2 K and 300 K. The net cooling power of a PTR might be e.g. 40 W at 50 K, and 0.5 W to 1 W at 4.2 K. The losses have been calculated to be of the order of 5–20 W. The internal working process of a pulse tube will, in general, be affected although this is not encountered in GM refrigerators. In a PTR, the optimum temperature profile in the tubes, which is a basis for optimum performance, arises through a delicate process balancing the influences of many parameters, e.g. geometries of all tubes, flow resistivities, velocities, heat transfer coefficients, valve settings etc. (A description can be found in Ray Radebaugh, proceedings of the $6^{th}$ International Cryogenic Engineering Conference, Kitakkyushu, Japan, 20–24 May, 1996, pp. 22–44).

Therefore, in a helium environment, PTRs do not necessarily reach temperatures of 4 K, although they are capable of doing so in vacuum. Nevertheless, if the PTR is inserted in a vacuum sock with a heat contact to 4 K through a solid wall, it would work normally. Such a solution has been described for a GM refrigerator (U.S. patent U.S. Pat. No. 5,613,367 to William E. Chen, G E) although the use of a PTR would be possible and be straightforward. The disadvantage, however, is that the thermal contact of the coldhead at 4 K would produce a thermal impedance, which effectively reduces the available power for refrigeration. As an example, With a state of the art thermal joint made from an Indium washer, a thermal contact resistance of 0.5 K/W can be achieved at 4 K (see e.g. U.S. Pat. No. 5,918,470 to GE). If a cryocooler can absorb 1 W at 4.2 K (e.g. the model RDK 408 by Sumitomo Heavy Industries) then the temperature of the recondensor would rise to 4.7 K, which would reduce the current carrying capability of the superconducting wire drastically. Alternatively, a stronger cryocooler would be required to produce 1 W at 3.7 K initially to make the cooling power available on the far side of the joint.

FIG. 5 shows an example of such a PTR arrangement 76. The component features are substantially the same as shown in FIG. 4. Thermal washer 78 is provided between the second stage of the PTR coldhead and a finned heat sink 26. A helium-tight wall is provided between the thermal washer and the heat sink.

OBJECT OF THE INVENTION

The present invention seeks to provide an improved pulse tube refrigerator.

STATEMENT OF THE INVENTION

In accordance with a first aspect of the invention, there is provided a pulse tube refrigerator PTR arrangement within a cryogenic apparatus, wherein a regenerator tube of a PTR is finned. Ideally, there is a plurality of fins. The fins conveniently comprise annular discs and are spaced apart along the length of the regenerator tube. Alternatively the fins comprise outwardly directed fingers or prongs. The fins may also, comprise a single spiral arrangement. Conveniently, an associated sock surrounds all the tubes of the pulse tube, leaving only a small annular gap between the regenerator and pulse tubes and a wall of the sock. The walls of the tubes can be fabricated from materials such as thin gauge stainless steel or alloys The invention provides a regenerator for a PTR which can act as a distributed cooler, that is to say that there is refrigeration power along the length of the regenerator. This means that the regenerator can intercept (absorb) some of the heat being conducted down the refrigerator sock (neck tube, helium column plus other elements). Whilst the absorption of this heat degrades the performance of the second stage, in one sense, this degradation is less than the heat which is extracted (intercepted) by the regenerator and therefore there is a net gain in cooling power. By placing fins along the regenerator the distributed cooling power of the regenerator is increased by enhancing the heat transfer (by increasing the surface area available for the transfer) to the helium column (and therefore the neck tube etc) that is to say, the fins or baffles, are believed to increase the surface area available for distributed heat transfer from the helium atmosphere to the regenerator.

BRIEF DESCRIPTION OF THE FIGURES

The invention may be understood more readily, and various other aspects and features of the invention may become apparent from consideration of the following description and the figures as shown in the accompanying drawing sheets, wherein.

DETAILED DESCRIPTION OF THE INVENTION

There will now be described, by way of example, the best mode contemplated by the inventors for carrying out the invention. In the following description, numerous specific details are set out in order to provide a complete understanding of the present invention. It will be apparent, however, to those skilled in the art, that the present invention may be put into practice with variations from the specific embodiments.

Figure 6A:
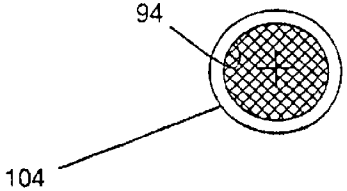
FIG. 6A shows a cross-section of a regenerator tube of the first embodiment.
Figure 6:
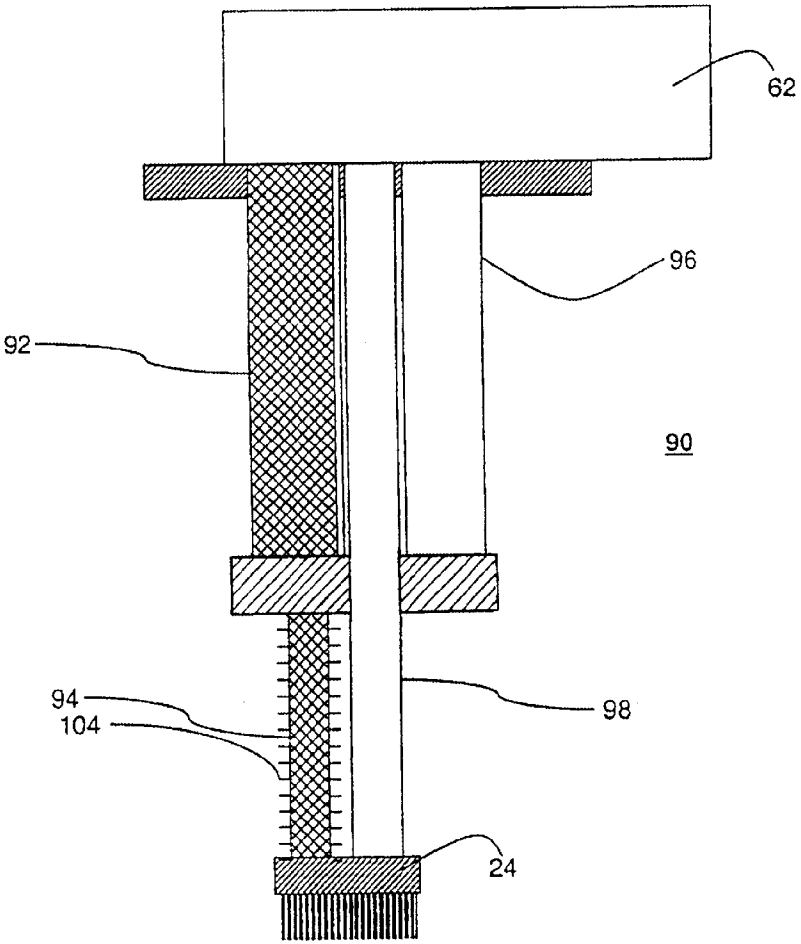
FIG. 6 shows a first embodiment of the invention.

Referring now to FIG. 6, there is shown a first embodiment of the invention, wherein a 2-stage PTR arrangement 90 is shown. Regenerator tubes 92, 94 and pulse tubes 96, 98 are shown with regenerator tube 94 being finned.

FIG. 6A shows a cross-section through the regenerator tube 94 showing annular fin 104 surrounding tube 94 in the form of an annular disc. Conveniently the tube wall and the fins are manufactured simultaneously, preferably from the same material which is moderately thermally conductive, such as an austenitic stainless steel. Other materials that could be used include brass and aluminium alloys. However, if the component materials of the fins and tube are different, then it is preferable that the fins are made of a material that is highly thermally conductive and that the tube is made of a material that is moderately thermally conductive. For low pressure PTRs, it would be possible to employ a composite material, which materials can be moderately thermally conductive, and provide fins made from copper or some other highly thermally conductive material, which would be bonded to the composite. It is to be noted that pure metals can be highly thermally conductive at low temperatures.

The fins should have very good thermal contact with the regenerator which can be achieved by, for example, soldering, welding or brazing. The fins intercept the heat being transferred down the helium columns, neck tube and other elements within the neck. It is believed that the absorption of the heat may degrade the performance of the second stage, although it is believed that this degradation in power is less than the heat extracted by the regenerator and therefore there is a net gain in the available cooling power and thus the recondensation rate of helium gas. The provision of fins increase the distributed cooling due to the enhanced heat transfer with the gas column arising as a result of the increased surface area available. These fins can also be used on the first stage regenerator in order to minimise the heat load from the 300 k stage to the first stage. Another advantage for this configuration is that these fins can work as barriers against the natural convection between the high temperature and low temperature levels. Accordingly, the natural convection and its heat load to the second stage, may be reduced.

Figure 7A:
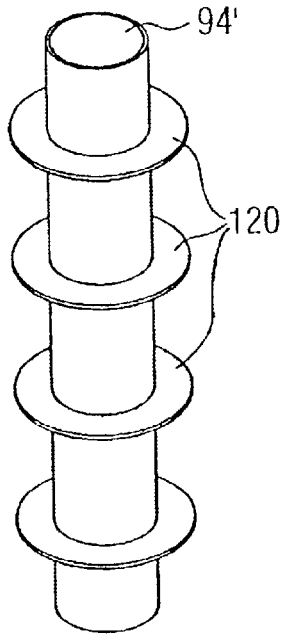
FIGS. 7A–G shows various forms of regenerator tubes.

In FIGS. 7A–F, different mechanical forms of the finned tube 94 are shown. In FIG. 7A the finning comprises an array of annular discs 120 about a straight regenerator tube. The tube wall is thick enough to withstand the surrounding helium pressure during evacuation without any buckling. The fins are conveniently placed at equi-spaced intervals and are preferably of the same dimension.

Figure 7B:
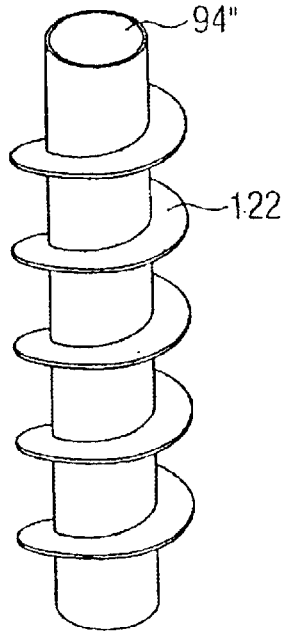
Figure 7C:
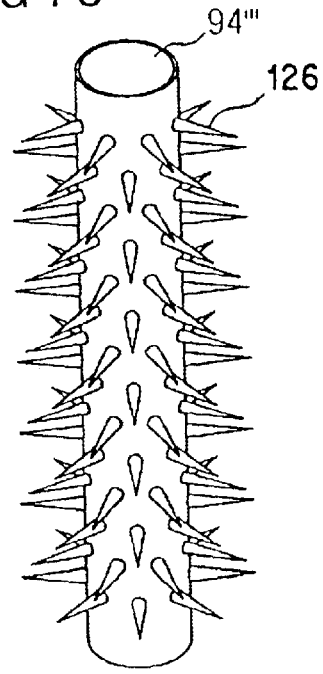

In FIG. 7B, the fin comprises a spiral tape 122, affixed to the regenerator tube 94". In FIG. 7C the fins comprise spikes 126 about tube 94''', in an arrangement somewhat akin to the spikes of a hedgehog. This arrangement would not, however, reduce convection currents about the tube, although would allow easier gas flow past the tube if it was required, for example, during a quench.

Figure 7D:
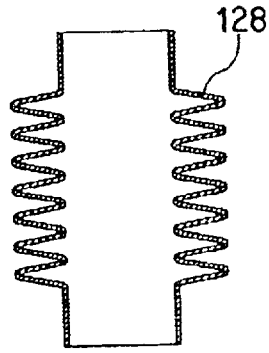
Figure 7E:
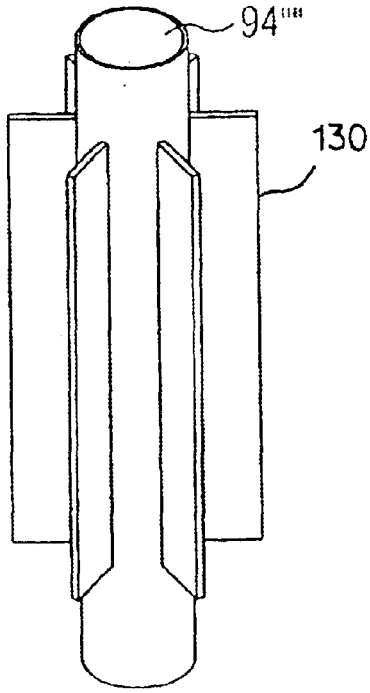

In FIG. 7D the tube 128 is corrugated in an arrangement similar to accordion bellows. In FIG. 7E plates 130 are placed about tube 94''''; the plates being attached such that they are parallel with the axis of the tube.

Figure 1:
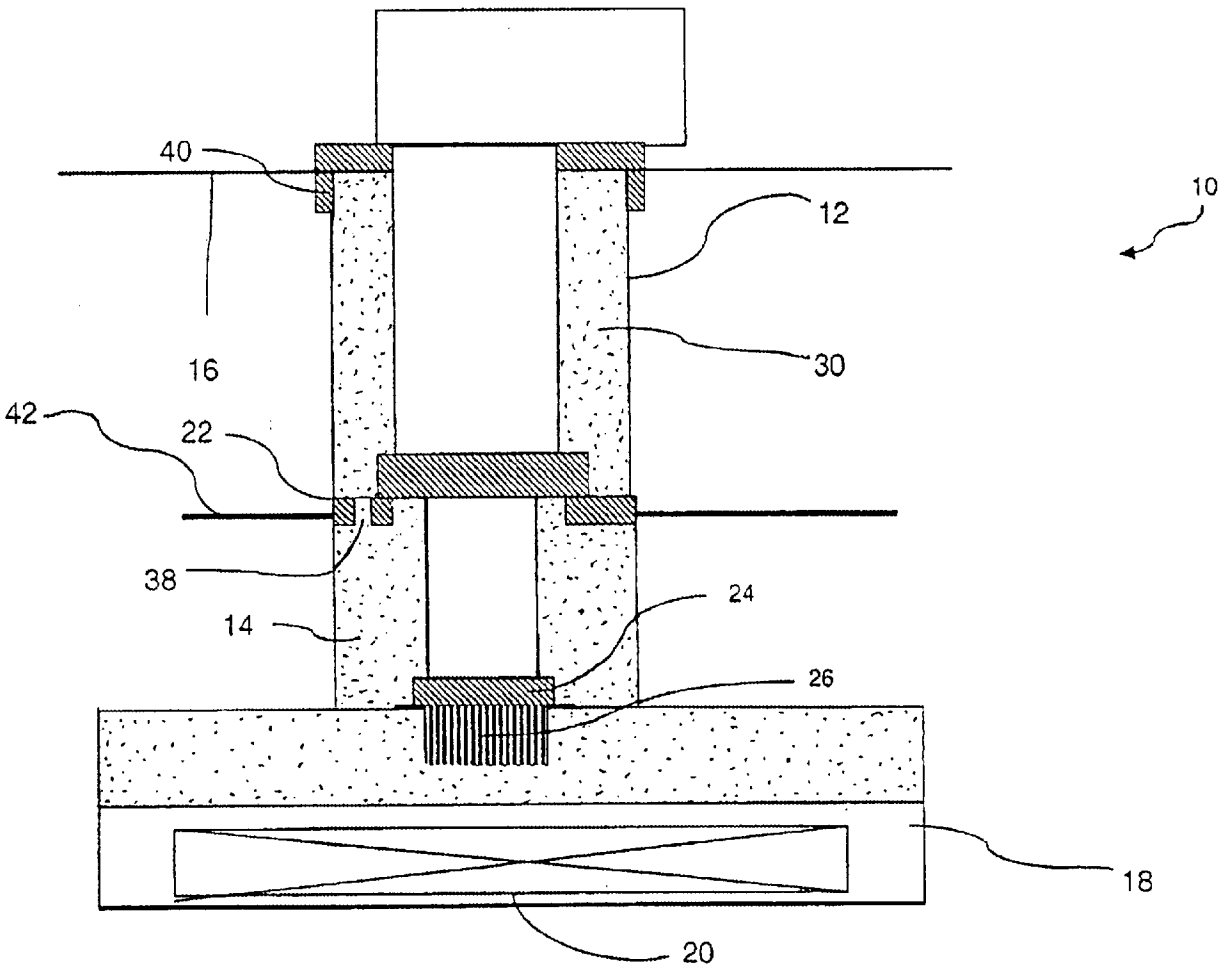
Figure 1 PRIOR ART
FIG. 1 shows a two stage Gifford McMahon coldhead recondenser in a MRI magnet.
Figure 2:
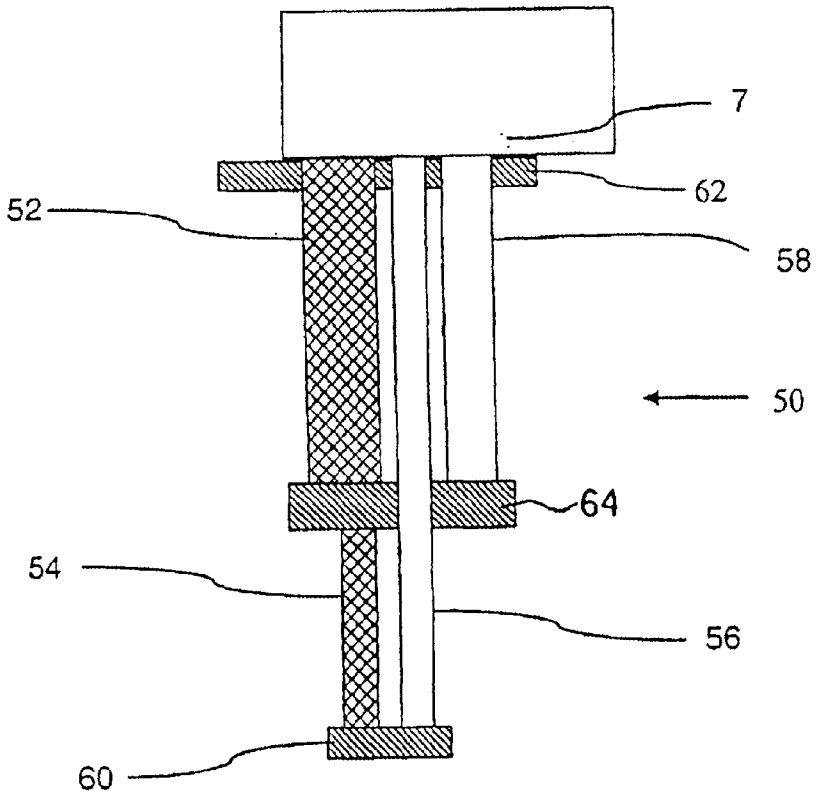
Figure 2 PRIOR ART
FIG. 2 shows a PTR consisting of an arrangement of separate tubes, which are joined together at the heat stations.
Figure 3:
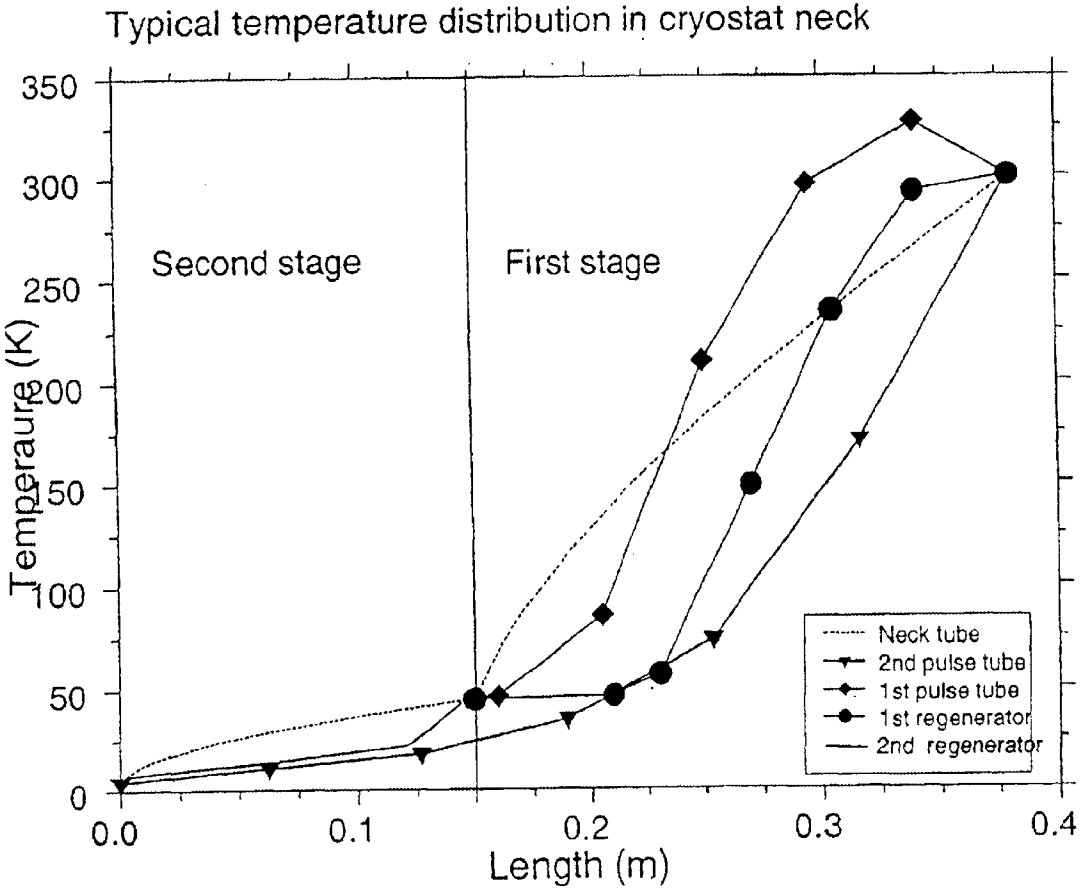
Figure 3 PRIOR ART
FIG. 3 shows a temperature profile in a sock.
Figure 4:
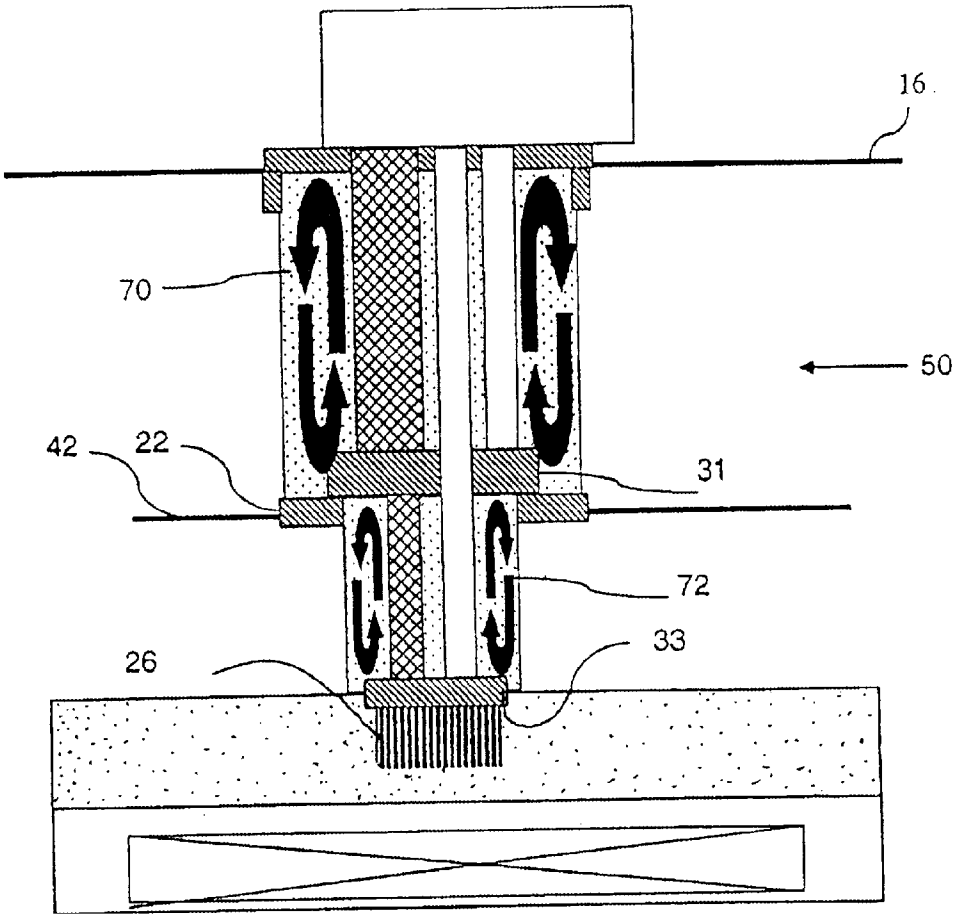
Figure 4 PRIOR ART
FIG. 4 shows a pulse tube inserted into a sock.
Figure 5:
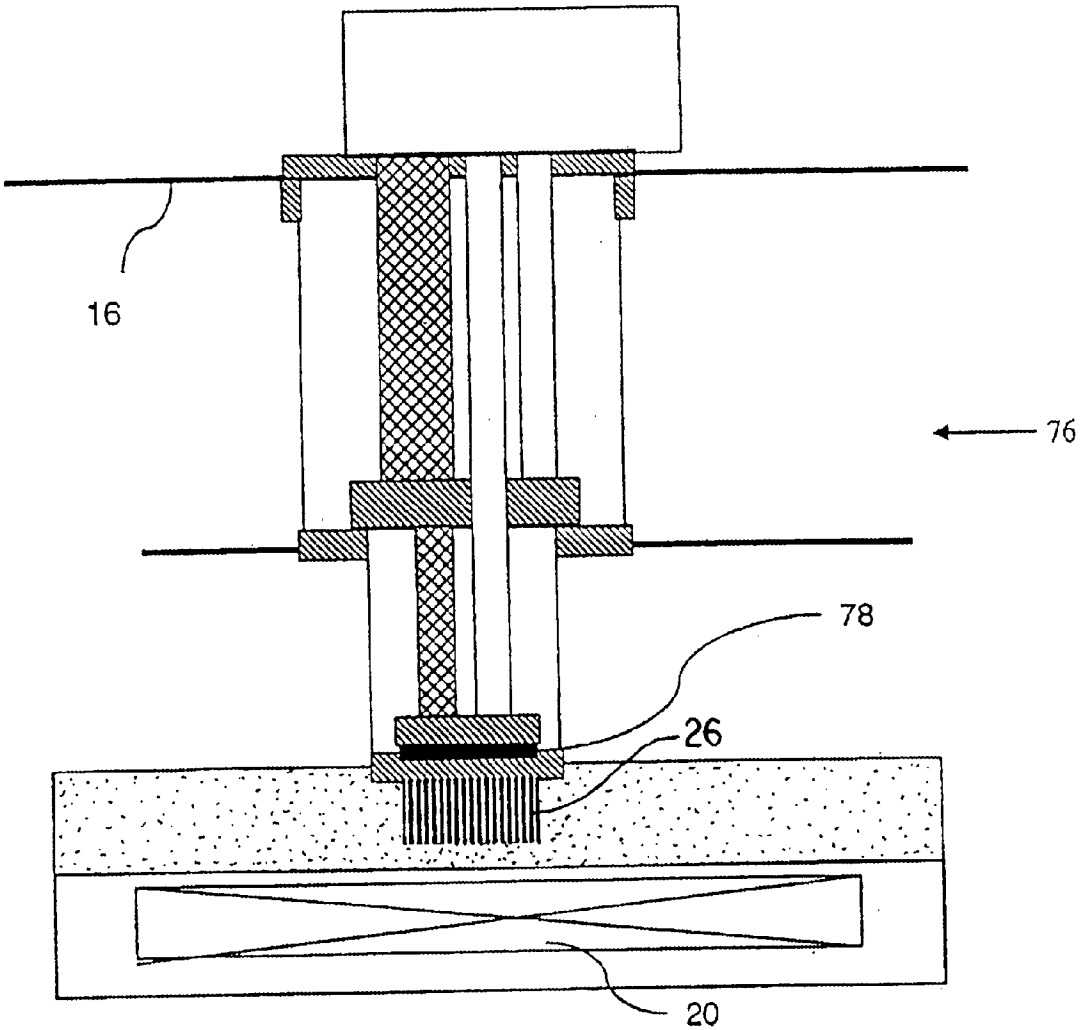
Figure 5 PRIOR ART
FIG. 5 shows a prior art example of a pulse tube with a removable thermal contact.
Figure 7F:
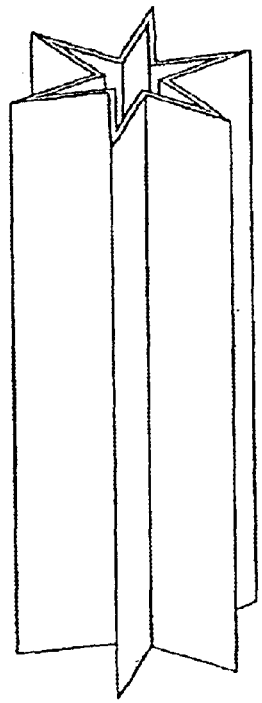
Figure 7G:
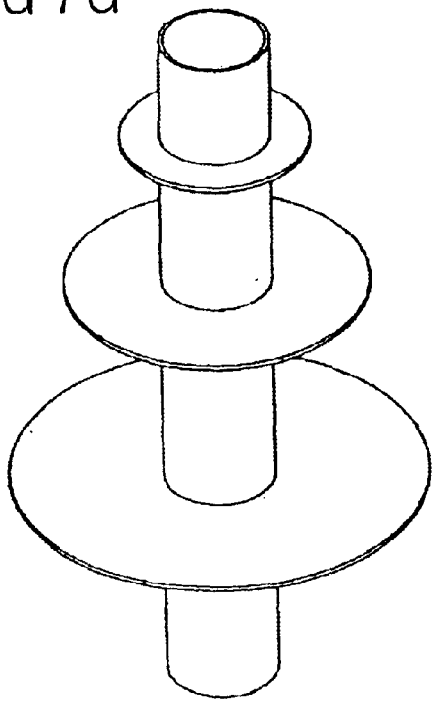

The tube of FIG. 7F is corrugated with creases arranged parallel with the axis of the tube. In FIG. 7G the fins comprise annular fins which cover only a portion of the length of the tube. This sort of tube is preferable for the upper sections since, as can be seen with reference to FIG. 3, that the temperature of the neck tube and the first regenerator correspond. That is to say to have a first regeneration tube fully finned along its length would be counterproductive to efficient operation.

The fins for individual tubes can differ amongst each other. In some applications it may be necessary to provide fins on the first stage and the second stage regenerators. The teaching of the present invention can be applied with the teaching disclosed in the PCT patent application number PCT/EP02/11882. In other words, in addition to the regeneration tubes having fins to aid heat conduction through the tube walls, the pulse tubes may be insulated to reduce heat conduction through the tube walls.

Figure 8:
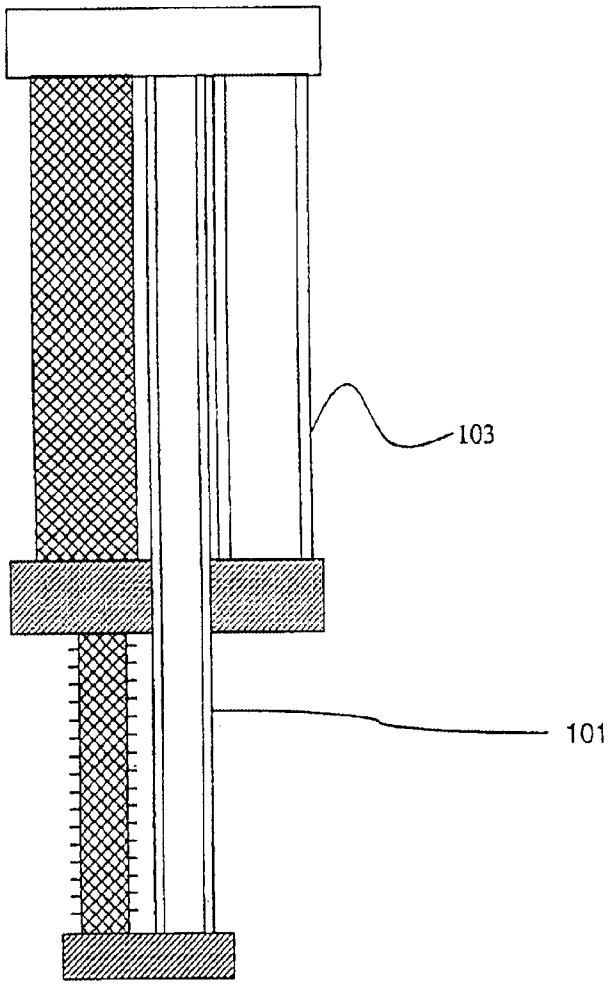
FIGS. 8–10 show further variations of the invention.
Figure 9:
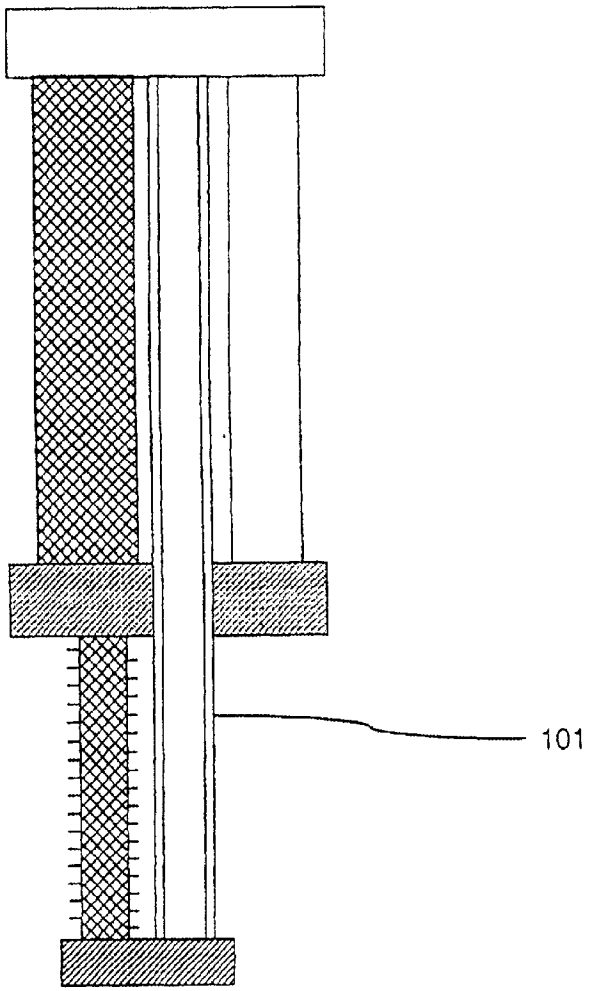
Figure 10:
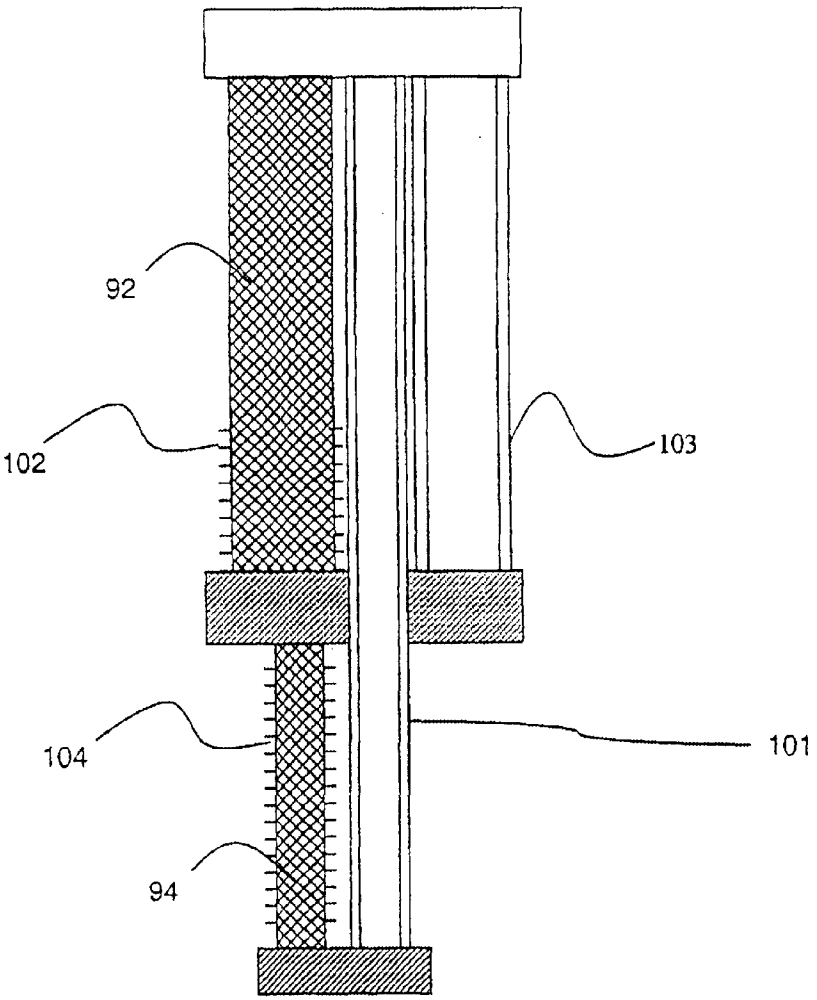

FIG. 8 shows pulse tubes 101, 103 with insulating sleeves and regeneration tube 94 with fins 104. FIG. 9 shows only pulse tube 101 with an insulating sleeve and regeneration tube 94 with fins. FIG. 10 shows a similar arrangement to FIG. 8 except that regeneration tube 92 is also provided with fin 102.

While most applications cryogenic temperatures, e.g. at or around 4 K for MRI apparatus operate with two stage coolers, the same technology can also be applied to single stage coolers or three and more stage coolers.

What is claimed is:

1. A pulse tube refrigerator (PTR) arrangement comprising a pulse tube and a regenerator tube within a cryogenic apparatus wherein:

the regenerator tube is finned; and a plurality of fins associated with the regenerator tube are arranged along the regenerator tube to transfer heat from an atmosphere surrounding said tubes to the regenerator tube.

2. A PTR arrangement according to claim 1, wherein the fins comprise annular fins.

3. A PTR arrangement according to claim 2, wherein the annular fins are spaced apart regularly, along an outside of the regenerator tube.

4. A PTR arrangement according to claim 2, wherein the annular fins are not of a uniform size.

5. A PTR arrangement according to claim 1, wherein the fins comprise one or more spirally arranged strip sheets.

6. A PTR arrangement according to claim 1, wherein the fins comprise outwardly extending prongs.

7. A PTR arrangement according to claim 1, wherein the fins comprise rectangular sheets attached about the circumference of the regenerator tube, the sheets being attached along one edge to the regenerator tube.

8. A PTR arrangement according to claim 1, wherein the regenerator tube is corrugated, either axially with respect to an axis of the tube or perpendicularly with respect to said axis, corrugations of said regenerator tube forming fins which comprise part of a wall of the regenerator tube.

9. A PTR arrangement according to claim 1, wherein the fins comprise one or more types of fin.

10. A PTR arrangement according to claim 1, wherein the regenerator tube is finned across part of its length.

11. A PTR arrangement according to claim 1, wherein the regenerator tube is fabricated from a thin walled alloy which has a moderate thermal conductivity at low temperatures.

12. A PTR arrangement according to claim 1, wherein the pulse tube has an insulated wall.

13. A PTR arrangement according to claim 1, wherein the PTR arrangement is associated with a magnetic resonance imaging apparatus.

14. A PTR arrangement according to claim 1, wherein the PTR arrangement is a multi-stage PTR arrangement, each stage having a pulse tube and a regenerator tube.

15. A PTR arrangement according to claim 14, wherein:

the PTR arrangement comprises two stages; and the second stage regenerator tube is finned.

16. A method of operating a pulse tube refrigerator (PTR) arrangement comprising a pulse tube and a regenerator tube within a cryogenic apparatus, wherein the regenerator tube is finned, the method comprising:

providing the PTR arrangement with a refrigerator sock containing a helium column that constitutes an atmosphere surrounding said tubes; and transferring heat from said atmosphere to the regenerator tube via fins associated with the regenerator tube.

17. A method according to claim 16 wherein the PTR arrangement is associated with a magnetic resonance imaging apparatus.

* * * * *